US006730890B2

(12) United States Patent
Kish et al.

(10) Patent No.: US 6,730,890 B2
(45) Date of Patent: May 4, 2004

(54) PROGRAMMABLE REMOTE CONTROLLED COOKING OR BAKING APPARATUS AND METHOD

(76) Inventors: Barbara Ann Kish, 14417 Park, Livonia, MI (US) 48154; Robert Peruski, 6668 Orchard Lake Rd., Suite 204, West Bloomfield, MI (US) 48322

( * ) Notice: Subject to any disclaimer, the term of this patent is extended or adjusted under 35 U.S.C. 154(b) by 0 days.

(21) Appl. No.: 10/310,409

(22) Filed: Dec. 6, 2002

(65) Prior Publication Data

US 2003/0075538 A1 Apr. 24, 2003

Related U.S. Application Data

(62) Division of application No. 09/711,836, filed on Nov. 13, 2000, now Pat. No. 6,552,309.

(51) Int. Cl.[7] ..... H05B 1/02

(52) U.S. Cl. ..... 219/506; 219/714; 219/413; 219/494; 99/325

(58) Field of Search ..... 219/714, 497, 219/501, 494, 506, 413, 412, 702; 99/325–333

(56) References Cited

U.S. PATENT DOCUMENTS 5,938,966 A * 8/1999 Oh et al. ..... 219/702
6,080,972 A * 6/2000 May ..... 219/494
6,137,095 A * 10/2000 Kashimoto et al. ..... 219/714
6,244,165 B1 * 6/2001 Trombley et al. ..... 99/331
6,283,014 B1 * 9/2001 Ng et al. ..... 99/330
6,557,756 B1 * 5/2003 Smith ..... 219/679
6,559,882 B1 * 5/2003 Kerchner ..... 219/506

* cited by examiner

*Primary Examiner*—Mark Paschall
(74) *Attorney, Agent, or Firm*—Alex Rhodes

(57) ABSTRACT

A programmable remote controlled apparatus and method for controlling the time and temperature of a cooking or a baking cycle. The apparatus comprises: a cooking or baking appliance, such as a conventional stove, broiler, conventional oven, convection oven, microwave oven or barbecue; a data storage and processing device such as a microprocessor or computer; a program stored in said microprocessor or computer for processing a code to control the time and temperature of the cooking or baking cycle; a device for entering a code into the microprocessor or computer; and a code which is provided by a party other than a user of the apparatus. The numeric code is entered at the remote site on a numeric keypad of a telephone apparatus or hand held transmitter.

13 Claims, 3 Drawing Sheets

PROGRAMMABLE REMOTE CONTROLLED COOKING OR BAKING APPARATUS AND METHOD

RELATED U.S. APPLICATION DATA

Division of application Ser. No. 09/711,836, filed on Nov. 13, 2000, now U.S. Pat. No. 6,552,309.

FIELD OF THE INVENTION

This invention relates to baking and cooking more particularly to a programmable remote controlled apparatus and method for controlling a cooking or baking cycle of a household appliance from a remote site.

BACKGROUND OF THE INVENTION

Improper times and temperatures can reduce and destroy the taste and quality of food. In many instances, time and/or temperature must be varied during a cooking or baking cycle for optimum results. Many persons fail to follow instructions or are unaware of the best times and temperatures.

In some cases, such as defrosting in microwave ovens, heating is best done in steps. Overcooked pasta, such as noodles and spaghetti, become soggy and distasteful High temperatures and times can destroy the flavor of foods, such as soups. Excessive times and temperatures waste energy and food resources and are unnecessarily costly to consumers.

SUMMARY OF THE INVENTION

The present invention is a means for establishing the time and temperature of a cooking or baking cycle. One benefit of the invention is that it conserves food and energy resources. Another benefit is that it simplifies cooking and baking. A still further benefit is that the cooking or baking apparatus can be pre-set to begin at a desired time. A still further benefit is that it allows a manufacturer to exercise control over the preparation of a food. A still further benefit is that a cooking or baking apparatus can be controlled from a remote location.

One characterizing feature of the invention is that the temperature and time of a baking or cooking cycle of an appliance is controlled by a code, such as a numeric code. As used herein, the term appliance is intended to include all forms of appliances, such as ovens, broilers, stoves, bread making machines and barbecues and the terms cooking and baking are intended to include all processes, such as cooking, baking, barbecuing, frying and broiling.

Another characterizing feature is that the source of the code is a party other than the appliance user. Another characterizing feature is that the code is provided on a food package, such as a can or a box. Another characterizing feature is that the code is applied at a site which is remote from the appliance.

In a first aspect of the invention, a numeric code on a package, such as a can or box, is entered into a numeric keypad of a touch tone telephone at a remote site and transmitted to a pre-programmed microprocessor. In a second aspect of the invention, a code is obtained from an internet site, entered into the telephone at the remote site and transmitted to the pre-programmed microprocessor. In a third aspect of the invention, the numeric code is entered into a keypad of a hand held transmitter at a remote site, transmitted to a receiver and entered into the pre-programmed microprocessor. In all aspects of the invention, a code is processed by a pre-programmed microprocessor, and the output of the microprocessor is used to control the time and temperature of a cooking or baking cycle of an appliance, such as a microwave oven, broiler, conventional oven, convection oven, barbecue or stove.

In employing the teaching of the present invention, a plurality of alternate constructions can be adopted to achieve the desired results and capabilities. In this disclosure, only several embodiments are discussed. However, the disclosed embodiments are intended as examples only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed descriptions of the preferred embodiments.

BRIEF DESCRIPTION OF THE DRAWINGS

The invention will be better understood and further objects, characterizing features, details and advantages thereof will appear more clearly with reference to the diagrammatic drawings illustrating specific embodiments of the invention by way of non-limiting example only.

DETAILED DESCRIPTIONS OF PREFERRED EMBODIMENTS

Figure 1:
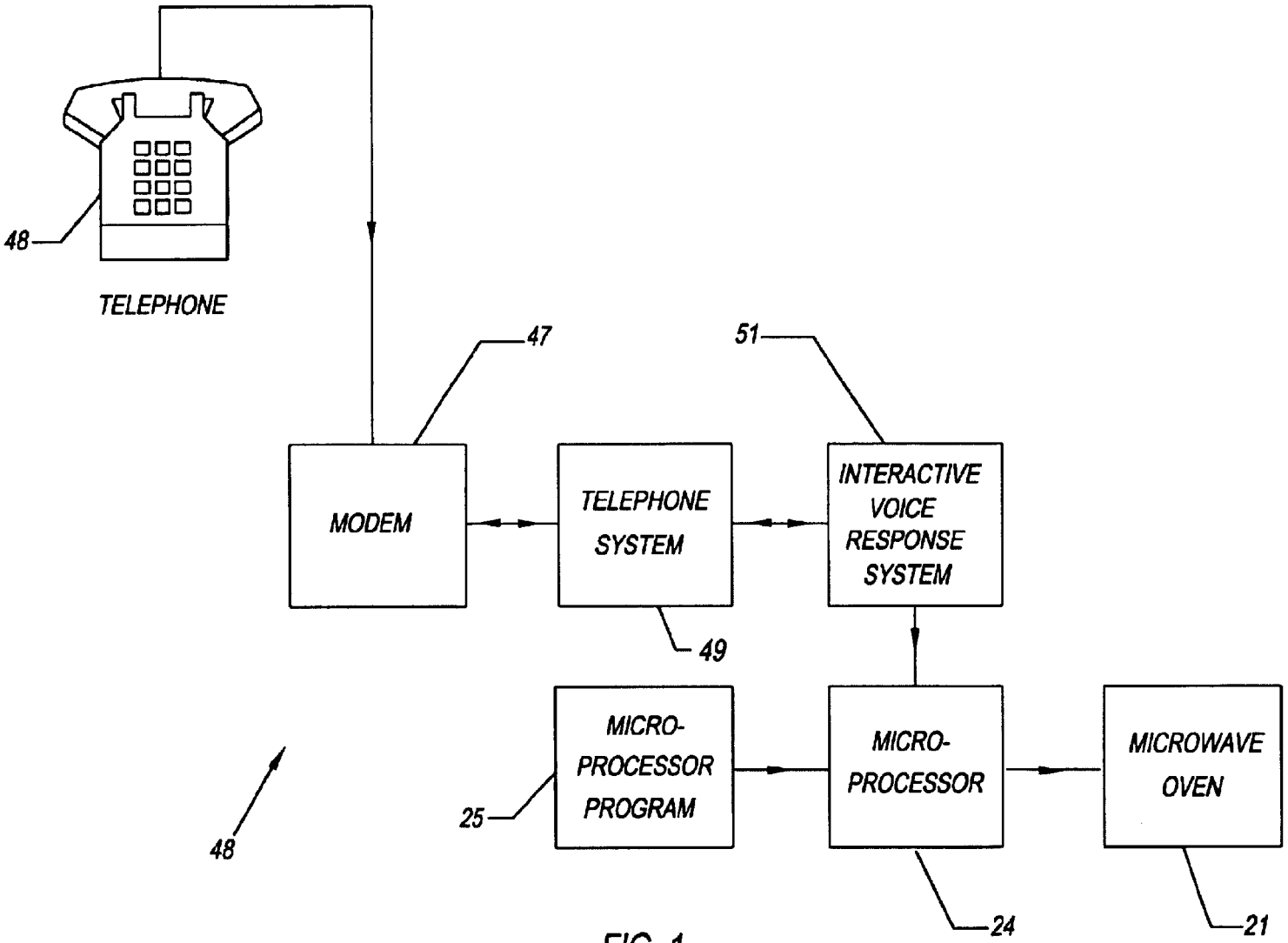
FIG. 1 is a block diagram of a microwave oven apparatus according to the present invention.
Figure 2:
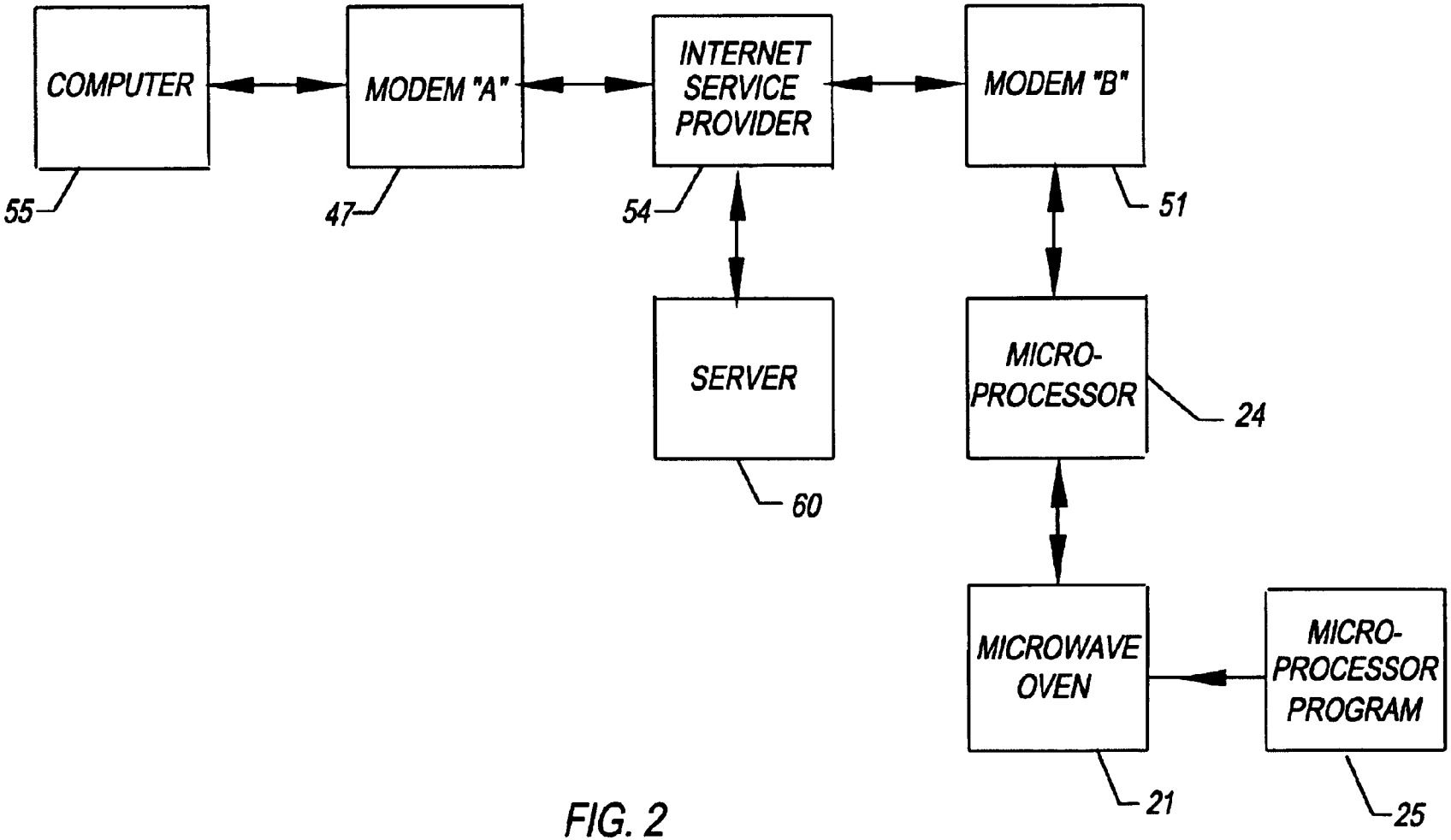
FIG. 2 is a block diagram of a second embodiment of the present invention.
Figure 3:
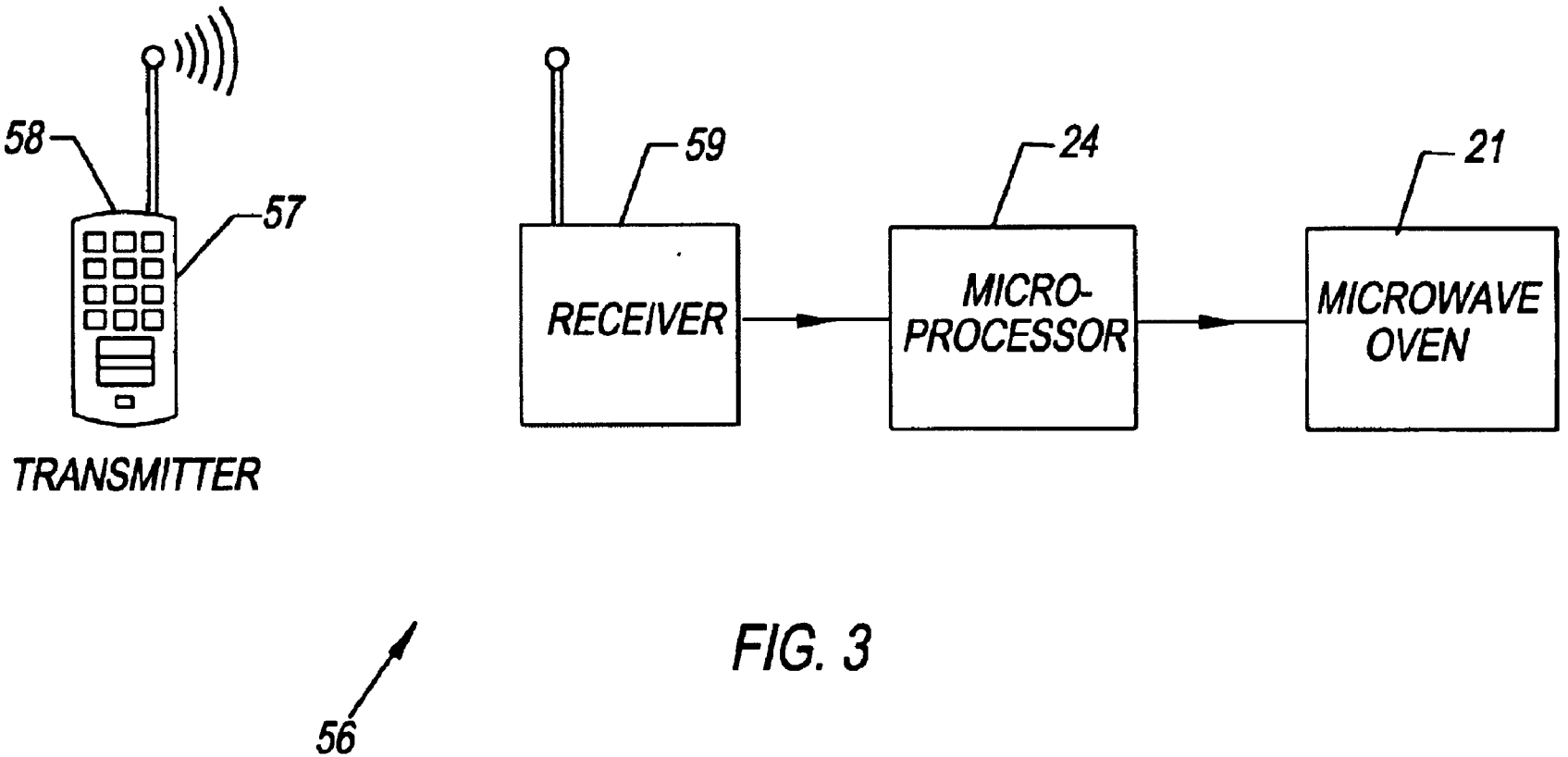
FIG. 3 is a block diagram of a third embodiment.

Referring now to the drawings wherein like numerals designate like and corresponding parts throughout the several views, a block diagram of a programmable remote controlled cooking apparatus 46 is shown in FIG. 1, according to the present invention. The cooking apparatus 46 which is depicted in the block diagram of FIG. 1, is comprised of a telephone, a microwave oven 21, and a pre-programmed computer or microprocessor 24 having a stored program for controlling the time and temperature of a cooking cycle of the microwave oven 21. The computer or microprocessor 24 is preferably a part of the microwave oven 21.

A characterizing feature of this embodiment is that a numeric code 41 is transmitted by a telephone 48 to a remote appliance 21. The embodiment 46 is comprised of a touch tone telephone 48 with an alpha-numeric keypad 50, a modem 47, a line or wireless telephone system 49, an interactive voice response system 51, a microprocessor 24, a microprocessor software program 25 and an appliance 21, such as the microwave oven. Interactive voice response systems 47 are available from InterVoice-Brite, Inc. of Dallas, Tex. The embodiment 46 typically functions as follows. A user enters a telephone number on the telephone's keypad 50.

The telephone system 48 opens a communication channel with the interactive modem 47. The interactive modern 47 responds to the user with the following message "enter your code 41". The user enters his code 41 by pressing the appropriate keys on the telephone's keypad 50. The interactive modem 47 repeats the code and instructs the user to press a key such as the star key if the code 41 is correct. After the user presses the star key, the modem 47 instructs the user to press a number key, such as the #1 key, if he desires to delay the start of the cooking or baking cycle. If the user presses the number key, the modem 47 requests the user to enter the delay time on the key pad 50. After the user enters the delay time, the modem 47 repeats the delay time and instructs the user to press the star key if the time is correct. The modem then prompts the user to enter a code for controlling the time and temperature of the cooking cycle. After the user enters the code and responds to a request to verify the correctness of the entry by pressing a key, such as the star key, the appliance 21 is programmed to start at the delayed time at the given temperature and time.

In the embodiment 53 of FIG. 12 a code for controlling the time and temperature of a cooking or baking cycle of an appliance 21 is obtained from a server computer 60 which is linked to a personal computer 55 by an internet service provider 54. The server 60 may be the server 60 of a food supplier, a manufacturer or an independent party. The embodiment 53 is comprised of the personal computer 55, a first modem 47, the internet service provider 54, a second modem 51, a microprocessor 24, a microprocessor program 25 and an appliance 21. The personal computer 55 communicates with the server 54 through the internet service provider 54. After the code 61 is selected at the personal computer 55, it is E-mailed to the microprocessor 24 via the internet service provider 54 and the second modem 51. It is processed in the microprocessor 24 and the output of the microprocessor 24 is used to control the cooking or baking cycle of the appliance 21.

In FIG. 13, an embodiment 56 is shown wherein a numeric code 41 for a cooking or baking cycle is entered into a keypad 57 of a hand held transmitter 56 and transmitted to a receiver 59 at a remote location. The code 41 is processed in the microprocessor 24 and the output of the microprocessor 24 is used to control the time, temperature and start of a cooking or baking cycle of an appliance 21

From the foregoing it will be appreciated that our invention simplifies and improves a cooking and baking cycle as well as conserving energy and food resources Although only several embodiments have been described, it will be understood that after having the benefit of our disclosure, other embodiments can be derived by changes such as substitutions of parts, changes in the arrangements of part, changes in materials, and changes in the design of parts without departing from the spirit thereof.

We claim:

1. A programmable remote controlled apparatus for controlling the time and temperature of a cooking or a baking cycle, comprising: a cooking or baking apparatus, such as a conventional stove, broiler, conventional oven, convection oven, microwave oven or barbecue; a code on a package of a food for establishing a baking or cooking time and temperature of a food product; a data storage and processing device such as a microprocessor or computer in said cooking or baking apparatus; a program stored in said microprocessor or computer for processing said code to control the time and temperature of said cooking or baking apparatus; and a remote means for entering said code into said microprocessor or computer to control said time and temperature of said cooking or baking cycle of said apparatus.

2. The programmable apparatus recited in claim 1 wherein said means for entering said code is a telephone.

3. The programmable apparatus recited in claim 1 wherein said package is a can.

4. The programmable apparatus recited in claim 1 wherein said package is a box.

5. The programmable apparatus recited in claim 1 wherein said means for entering said code is a numeric key pad.

6. The programmable apparatus recited in claim 1 wherein said code is a numeric code.

7. The programmable apparatus recited in claim 6 wherein said numeric code is provided by said food supplier in a written instrument.

8. A programmable remote controlled apparatus for controlling a cooking or a baking cycle, comprising: a cooking or baking apparatus, such as a conventional stove, broiler, conventional oven, convection oven or microwave oven, said apparatus having a data storage and processing device such as a computer or microprocessor, a numeric code on a package of food; a program in said computer or microprocessor for processing said numeric code on said package of food to control the time and temperature of said cooking or baking cycle of said cooking or baking apparatus, and a remote means for entering said numeric code into said computer or microprocessor.

9. The programmable apparatus recited in claim 8 wherein said means for entering said code is a keypad.

10. A programmable remote controlled apparatus for controlling a cooking or a baking cycle, comprising: a cooking or baking appliance, such as a conventional stove, broiler, conventional oven, convection oven, microwave oven or barbecue, said appliance having a data storage and processing device such as a computer or microprocessor; a numeric code on a package for establishing a time and temperature for cooking or baking a food; a program in said computer or microprocessor for processing said code on said food package to control said time and temperature of said cooking or baking, and a means for transmitting said code to said computer or microprocessor from a site which is remote from said cooking or baking appliance.

11. The programmable apparatus recited in claim 10 wherein said means for transmitting said code to said computer or microprocessor from said site which is remote from said cooking or baking appliance is a telephone apparatus.

12. A method for controlling a time and temperature of a cooking or baking apparatus, such as a conventional stove, broiler, convection oven or microwave oven comprising: the steps of reading a supplier's numeric code on a food package of said supplier containing a food product of said supplier, transmitting said code from a remote site to said apparatus, processing said code in a programmed data storage and processing device of said apparatus; using an output of said data storage and processing device to control the time and temperature of said food product in said cooking or baking apparatus.

13. The method recited in claim 12 further comprising the steps of entering a time in a keypad of a telephone to begin baking or cooking said food product in said cooking or baking apparatus; entering a time for ending said cooking or baking apparatus in said key pad of said telephone; processing said data in said pre-programmed data storage and processing device of said apparatus; and using an output of said data storage and processing device to control said beginning and ending times of said cooking or baking in said apparatus.

* * * * *